US011156339B2

(12) United States Patent
Dahlen et al.

(10) Patent No.: US 11,156,339 B2
(45) Date of Patent: Oct. 26, 2021

(54) LUMINAIRE WITH UPLIGHTING AND DOWNLIGHTING CAPABILITIES

(71) Applicant: KENALL MANUFACTURING COMPANY, Kenosha, WI (US)

(72) Inventors: Kevin Dahlen, Lindenhurst, IL (US); Brandon Stolte, Lindenhurst, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 206 days.

(21) Appl. No.: 16/570,793

(22) Filed: Sep. 13, 2019

(65) Prior Publication Data

US 2020/0003391 A1 Jan. 2, 2020

Related U.S. Application Data

(63) Continuation of application No. 15/666,289, filed on Aug. 1, 2017, now Pat. No. 10,451,249.

(51) Int. Cl.

| | |
|---|---|
| ***F21V 7/00*** | (2006.01) |
| ***F21V 15/01*** | (2006.01) |
| *F21Y 115/10* | (2016.01) |
| *F21Y 105/18* | (2016.01) |

(52) U.S. Cl.

CPC ..... *F21V 7/0016* (2013.01); *F21V 15/01* (2013.01); *F21Y 2105/18* (2016.08); *F21Y 2115/10* (2016.08)

(58) Field of Classification Search

CPC .. F21S 8/04–068; F21V 7/0016; F21V 15/01; F21Y 2115/10

See application file for complete search history.

(56) References Cited

U.S. PATENT DOCUMENTS

| | | | | |
|---|---|---|---|---|
| 2,032,798 | A | 3/1936 | Glatthar et al. | |
| 4,280,170 | A | 7/1981 | Baldwin | |
| 4,974,137 | A | 11/1990 | Evans, Jr. et al. | |
| 2012/0307496 | A1 * | 12/2012 | Phillips, III | F21V 5/04 362/245 |
| 2014/0254154 | A1 | 9/2014 | Catalano | |
| 2014/0268816 | A1 * | 9/2014 | Ricci | F21V 5/00 362/311.13 |
| 2018/0220508 | A1 * | 8/2018 | Pilat | H05B 45/20 |

* cited by examiner

*Primary Examiner* — Gerald J Sufleta, II

(74) *Attorney, Agent, or Firm* — Marshall, Gerstein & Borun LLP; Randall G. Rueth

(57) ABSTRACT

A luminaire with uplighting and downlighting capabilities is provided. According to one aspect, the luminaire may include a housing, a light source disposed in the housing, and a lens. The light source may be configured to emit light in a downward direction, and the lens may at least partially cover the light source. An opening may be formed in a top part of the housing and may permit light reflected by an interior surface of the lens to be transmitted in an upward direction from the housing. Optionally, a transparent or translucent cover member may at least partially cover the opening in the top part of the housing.

19 Claims, 3 Drawing Sheets

LUMINAIRE WITH UPLIGHTING AND DOWNLIGHTING CAPABILITIES

CROSS-REFERENCE TO RELATED APPLICATION

This is a continuation of U.S. patent application Ser. No. 15/666,289, filed Aug. 1, 2017, the entire contents of which are hereby incorporated by reference.

FIELD OF DISCLOSURE

The present disclosure generally relates to luminaires and, more particularly, to luminaires with uplighting capabilities.

BACKGROUND

Many commercial buildings, parking structures, transportation areas or structures (e.g., tunnels), and the like are equipped with lighting systems that include one or more luminaires or light fixtures for illuminating certain areas. Most luminaires are arranged overhead and configured to emit light in a downward direction where people, objects, vehicles, etc. are situated. In addition to such downlighting, in certain situations it may also be preferable to emit light in an upward direction to, for example, illuminate a ceiling or other overhead structure. To provide such uplighting, it may be necessary to provide additional light sources, separate from the downwardly emitting light sources, aimed in the upward direction. However, the time and costs associated with installing and operating such additional light fixtures oftentimes makes uplighting unfeasible.

The present disclosure sets forth luminaires embodying advantageous alternatives to existing luminaires, and that may address one or more of the challenges or needs mentioned herein, as well as provide other benefits and advantages.

SUMMARY

One aspect of the present disclosure provides a luminaire including a housing, a light source, and a lens. The light source may be disposed in the housing and configured to emit light in a downward direction. The lens may at least partially cover the light source and include an interior surface. An opening may be formed in the housing and permit light reflected by the interior surface of the lens to be transmitted in an upward direction from the housing.

Another aspect of the present disclosure provides a lens including an interior surface defining a cavity, a center portion, an outer peripheral portion, and a step-shaped shoulder portion. The outer peripheral portion may be disposed around the center portion and extend upwardly relative to the center portion. The step-shaped shoulder portion may connect the center portion and the outer peripheral portion.

An additional aspect of the present disclosure provides a luminaire including: (a) a housing including a top part and a bottom part; (b) a means for emitting light in a downward direction toward an opening formed in the bottom part of the housing; (c) a means for diffusively transmitting a first portion of the light in the downward direction; (d) a means for reflecting a second portion of the light in an upward direction; and (e) a means for transmitting the second portion of the light through the top part of the housing.

BRIEF DESCRIPTION OF THE DRAWINGS

It is believed that the disclosure will be more fully understood from the following description taken in conjunction with the accompanying drawings. Some of the drawings may have been simplified by the omission of selected elements for the purpose of more clearly showing other elements. Such omissions of elements in some drawings are not necessarily indicative of the presence or absence of particular elements in any of the exemplary embodiments, except as may be explicitly delineated in the corresponding written description. Also, none of the drawings is necessarily to scale.

DETAILED DESCRIPTION

Figure 1:
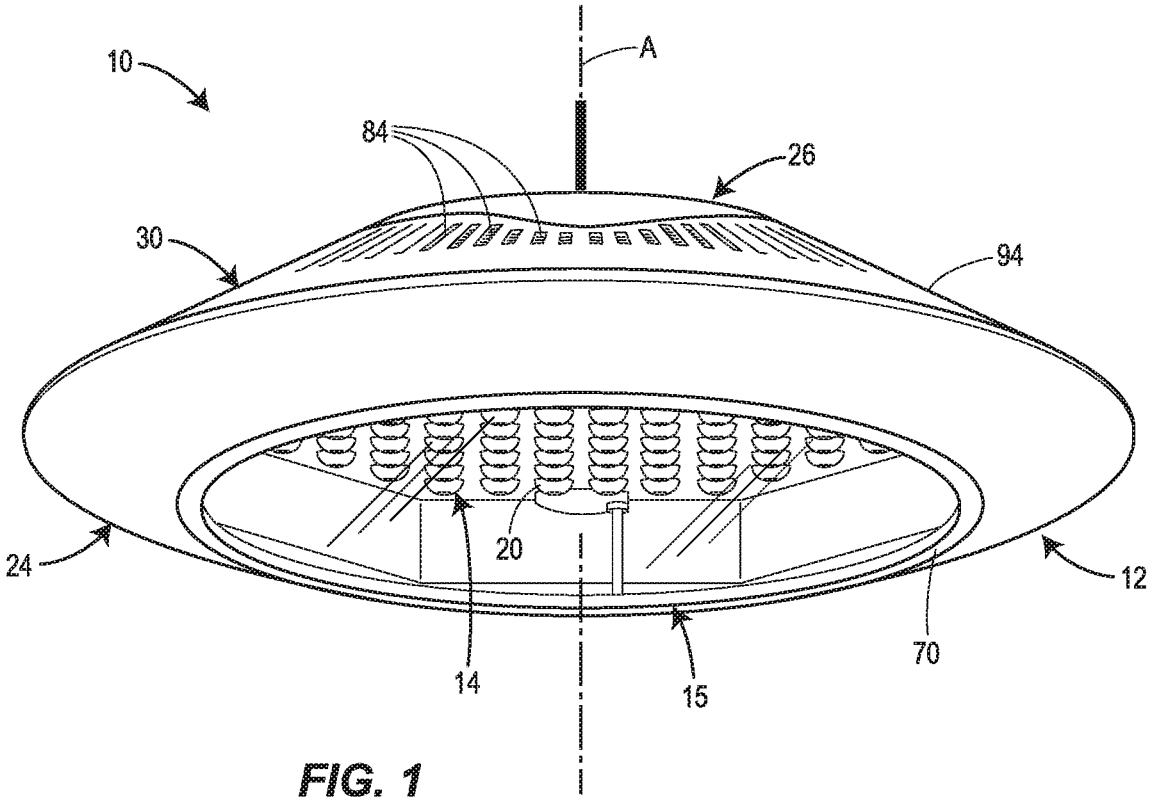
FIG. 1 is a perspective bottom view of an embodiment of a luminaire in accordance with principles of the present disclosure.

FIGS. 1-4 illustrate one embodiment of a lighting fixture or luminaire 10 constructed in accordance with the present disclosure. The luminaire 10 is generally suitable for either outdoor use or indoor use. The luminaire 10 may, for example, be used in a parking garage, commercial building, roadway, tunnel, residential home or building, or other structure or environment. In some embodiments, the luminaire 10 may be associated with a lighting system or a portion thereof, such as, for example, a lighting system included or employed in a parking garage (or a floor or section of the parking garage), commercial building (or a portion thereof), roadway, tunnel, or other structure (or a portion thereof), residential home or building, or other indoor or outdoor space or environment. In some embodiments, such a lighting system may include a plurality of luminaires 10. In one version, the lighting system may include a plurality of uniformly constructed luminaires 10. In another version, the lighting system may include a plurality of luminaires 10 of different types, sizes, and/or shapes. The plurality of luminaires 10 may be connected to one another via a wired or wireless connection (e.g., such as to form a mesh network).

As depicted in FIGS. 1-4, the luminaire 10 may include a housing 12, a light source 14 connected to (e.g., installed or mounted within) the housing 12, a lens 15 connected to the housing 12 and covering or enclosing the light source 14, and an electronics control assembly 16 connected to (e.g., installed or mounted within) the housing 12. In the depicted version, the light source 14 is a generally circular light-emitting diode (LED) board 19 with multiple LEDs 20 each being configured to emit light generally in a downward direction toward an upwardly facing portion of the interior surface 22 of the lens 15. The housing 12 may include a bottom part 24 and a top part 26 such that the bottom part 24 faces toward the ground when the luminaire 10 is installed. An opening 28 (see FIG. 3), or multiple openings, may be defined by the top part 26 of the housing 12 and may permit light reflected by the upwardly facing portion of the interior surface 22 of the lens 15 to escape in an upward direction through the top part 26 of the housing 12. Light from the light source 14 which is not reflected by the lens 15 in the upward direction may be diffusively transmitted through the lens 15 in a downward direction. So configured, the luminaire 10 advantageously provides both downlighting and uplighting via a single downwardly-directed light source 14. Optionally, a transparent or translucent cover member 30 may be connected to the housing 12 to at least partially cover at least a portion of the opening 28 to prevent debris from entering the housing 12 and/or scattering the uplighting.

Each of the foregoing components of the luminaire 10 will now be described in more detail.

With continued reference to FIGS. 1-4, the housing 12 may define an enclosed or interior space 32 containing the light source 14, the electronics control assembly 16, one or more mounting structures, and other internal components not explicitly illustrated such as, for example, wiring, one or more communication modules (e.g., one or more antennae, receivers, and/or transmitters), one or more transformers, one or more sensors (e.g., one or more ambient light sensors, motion sensors, and/or temperature sensors), and/or other electrical components. Also, while not explicitly depicted, the electronics control assembly 16 may include one or more boards (e.g., one or more printed circuit boards and/or user interface boards), one or more controllers (e.g., one or more microprocessors), and/or a one or more computer data storage units or memories.

Figure 3:
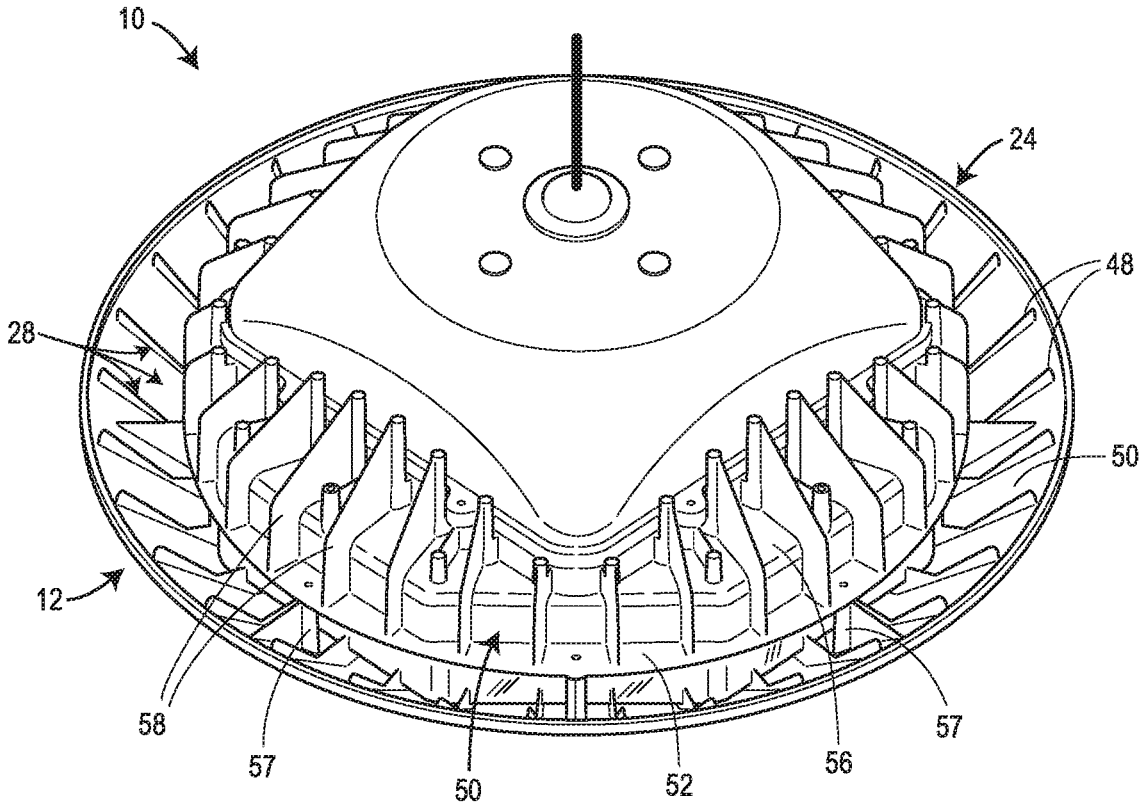
FIG. 3 is a perspective top view of the embodiment of the luminaire illustrated in FIG. 1, with the cover member omitted to reveal the opening in the top part of the housing.
Figure 4:
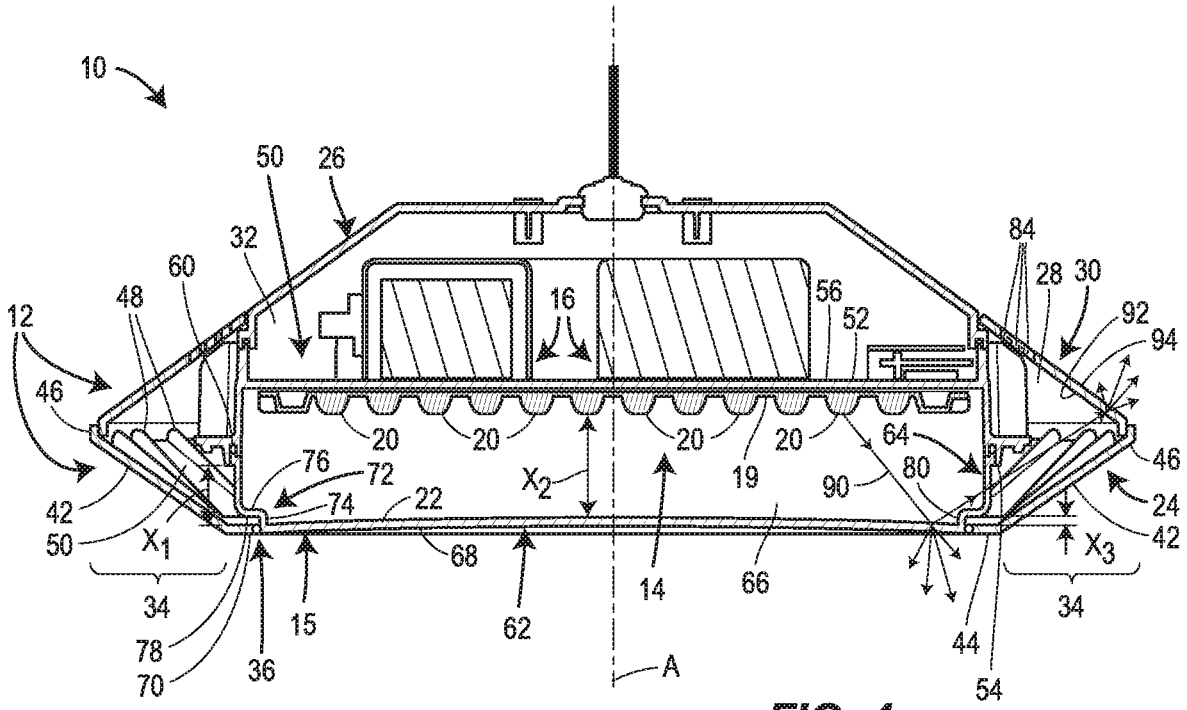
FIG. 4 is a cross-sectional view taken along imaginary line 4-4 of FIG. 2.

As shown in the illustrated embodiment, the bottom part 24 and the top part 26 of the housing 12 may be separate components which are fastened or otherwise connected together to define the interior space 32. In alternative embodiments, the bottom part 24 and the top part 26 may be integrally formed as a single, unitary structure. At least a portion of the perimeter of the opening 28 may be defined by the top part 26 of the housing 12, as shown in FIG. 3. In the illustrated embodiment, a portion of the perimeter of the opening 28 is also defined by the bottom part 24 of the housing 12, such that the opening 28 is defined between the top part 26 of the housing 12 and the bottom part 24 of the housing 12. In alternative embodiments, the perimeter of the opening 28 may be defined solely by the top part 26 of the housing 12. Referring to FIG. 4, an outer peripheral portion 34 of the housing 12 may correspond to the portion of the housing 12 which is disposed radially outwardly of the lens 15. The outer peripheral portion 34 of the housing 12 may include a portion of the bottom part 24 of the housing 12 and/or a portion of the top part 26 of the housing 12. As shown in FIG. 4, the opening 28 may be formed in a portion of the outer peripheral portion 34 of the housing 12 defined by the top part of the housing 12.

The top part 26 of the housing 12 may generally have a dome shape; whereas the bottom part 24 of the housing 12 may generally have an inverted dome shape. An opening 36 may be formed in the bottom part 24 of the housing 12 and may be centrally aligned with a longitudinal axis A of the luminaire 10. The lens 15 extend across and partially, or entirely, cover the opening 36 when attached to the housing 12. Furthermore, the bottom part 24 of the housing 12 may include an annular wall 42 that extends around the longitudinal axis A. A first end 44 of the annular wall 42 may define a perimeter of the opening 36. In some embodiments, such as the one illustrated in FIGS. 1-4, the first end 44 of the annular wall 42 may extend radially inwardly (relative to the longitudinal axis A) from a second end 46 of the annular wall 42 in a direction that is perpendicular or substantially perpendicular to the longitudinal axis A of the luminaire 10. The second or flared end 46 of the annular wall 42 may extend upwardly and radially outwardly (relative to the longitudinal axis A) from the first end 44 of the annular wall 42. The resulting inclined or sloping configuration of the second end 46 of the annular wall 42 may provide a light pathway or corridor for light reflected at an angle from the upwardly facing portion of the interior surface 22 of the lens 15 to escape from the housing 12. In some embodiments, the incline of the second end 46 of the annular wall 42 relative to the upwardly facing portion of the interior surface 22 of the lens 15 may be such that at least some of the light rays reflected by the upwardly facing portion of the interior surface 22 of the lens 15 can escape through the opening 28 without striking or otherwise being obstructed by the bottom part 24 of the housing 12 (see FIG. 4). Additionally, or alternatively, the incline of the second end 46 of the annular wall 42 relative to the upwardly facing portion of the interior surface 22 of the lens 15 may be such that at least some of the light rays reflected by the upwardly facing portion of the interior surface 22 of the lens 15 strike the second end 46 of the annular wall 42 and are reflected upwardly in a direction that is more parallel to the longitudinal axis A. Furthermore, as shown in FIG. 4, a plurality of fins 48 may protrude inwardly from an interior surface 50 of the annular wall 42. These fins 48 may serve to reinforce the annular wall 42 to ensure its rigidity and/or assist with heat dissipation by increasing the surface area of the annular wall 42.

The first end 44 of the annular wall 42 may define a lip which extends radially inwardly (relative to the longitudinal axis A) from the second end 46 of the annular wall 42. In some embodiments, the first end 44 of the annular wall 42 may be perpendicular or substantially perpendicular to the longitudinal axis A such that the first end 44 of the annular wall 42 is parallel or substantially parallel to the horizontal direction when the luminaire 10 is installed. As discussed below in more detail, the lip defined by the first end 44 of the annular wall 42 may be arranged vertically below an upwardly extending outer peripheral portion 64 of the lens 15, thereby obstructing this portion of the lens 15 from view and/or providing it with protection.

In terms of materials, the housing 12 may be manufactured from any suitably rigid and/or durable material including, but not limited to, metal (e.g., die cast aluminum and/or stainless steel) and/or certain types of plastic.

Figure 2:
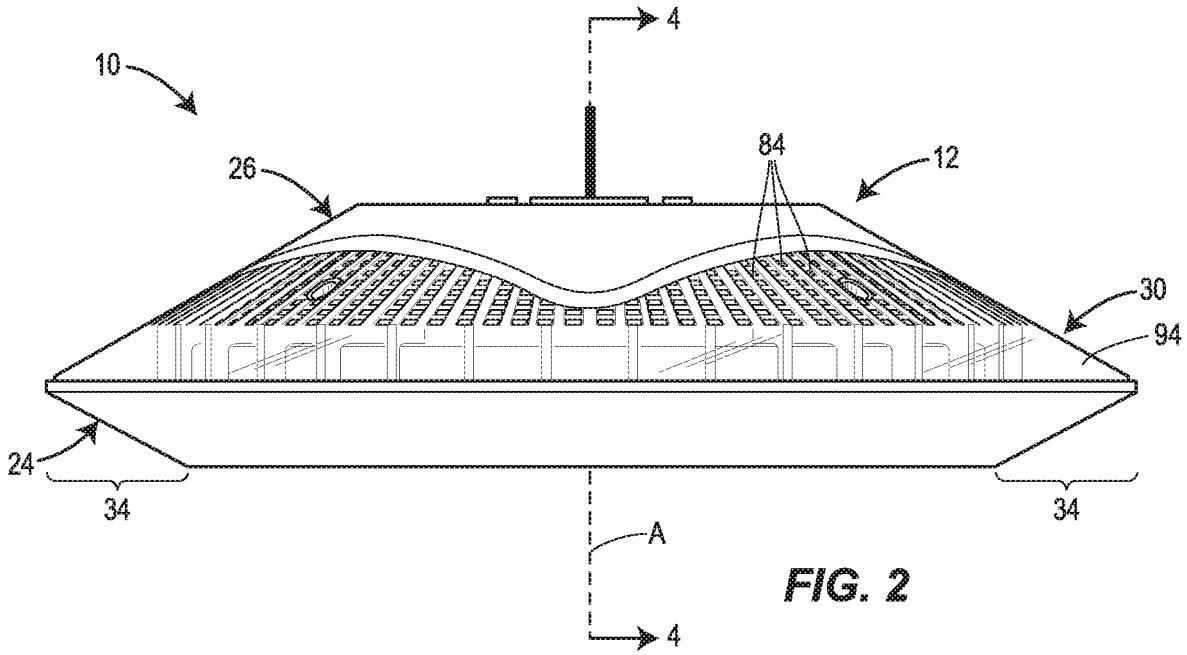
FIG. 2 is a side view of the embodiment of the luminaire illustrated in FIG. 1.

In other versions of the luminaire 10, the housing 12 may be constructed differently. More particularly, the housing 12 can have a different size, shape, and/or be made of one or more materials other than or in addition to metal or plastic. For example, instead of having saucer-like appearance as shown in FIGS. 1 and 2, the housing 12 may have a rectangular, square, triangular, irregular, or any other suitable shape.

Referring to FIGS. 3 and 4, a mounting assembly 50 may be disposed in the housing 12 and may be configured to connect and/or support various components of the luminaire 10. The mounting assembly 50 may include a support plate 52 and one or more fasteners or other connection members for rigidly connecting various components to the support plate 52. In the illustrated embodiment, the support plate 52 is integrally formed as a single, unitary structure. In alternative embodiments, the support plate 52 may be formed by multiple distinct structures which are rigidly connected to each other.

The support plate 52 may include a downwardly facing surface 54 and an upwardly facing surface 56. As shown in FIG. 4, the light source 14 may be mounted on a central portion of the downwardly facing surface 54 of the support plate 52. Additionally, as seen in FIG. 3, the downwardly facing surface 54 of the support plate 52 may be connected to the bottom part 24 of the housing 12. This connection may be achieved through one or more boss members 57 which extend upwardly in a direction parallel or substantially parallel to the longitudinal axis A from the bottom part 24 of the housing 12, and which receive a screw or other fastening member (not illustrated) which extends through a hole in the support plate 52. This configuration may result in at least a portion of the downwardly facing surface 54 of the support plate 52 being spaced apart from the opening 36 in the bottom part 24 of the housing 12 by a vertical distance X1, as shown in FIG. 4. The vertical separation distance X1 may be achieved through other configurations as well.

FIG. 4 illustrates that the downwardly facing surface 54 of the support plate 52 may also be connected to an outer peripheral portion 64 of the lens 15 such that the outer peripheral portion 64 of the lens 15 is suspended from the support plate 52. A recess or groove 60 may be formed in the downwardly facing surface 54 of the support plate 52 and extend around the longitudinal axis A of the luminaire 10. The groove 60 may receive an upper end or rim of the outer peripheral portion 64 of the lens 15. In some embodiments, a gasket (e.g., an O-ring) or other flexible seal member 62 may be positioned in the groove 60 to create a fluid-tight and/or air-tight seal between the outer peripheral portion 64 of the lens 15 and the support plate 52. The outer peripheral portion 64 of the lens 15 may extend downwardly from the groove 60 toward the opening 36 in the bottom part 24 of the housing 12 such that the outer peripheral portion 64 of the lens 15 spans at least a portion of the vertical distance X1 between the downwardly facing surface 54 of the support plate 52 and the opening 36 in the bottom part 24 of the housing 12. This configuration may result in at least a center portion 62 of the lens 15 being suspended from the support plate 62 by a vertical distance. Other configurations are also possible for suspending the lens 15 from the mounting assembly 50.

Still referring to FIGS. 3 and 4, the electronics control assembly 16 and the top part 26 of the housing 12 may be mounted on the upwardly facing surface 56 of the support plate 52. A plurality of fins 58 may protrude from the upwardly facing surface 56 of the support plate 52. The fins 58 may help dissipate heat generated by the light source 14 and/or the electronics control assembly 16 by increasing the surface area of the support plate 52. In this way, the support plate 52 may serve as a heat sink.

As illustrated in FIG. 4, the light source 14 may include a generally circular and planar LED board 19 and a plurality of LEDs 20 which are mounted in a pattern on a downwardly facing surface of the LED board 19. In addition to or as an alternative to the LEDs 20, the light source 14 may include other light emitting elements such as, for example, one or more incandescent bulbs, one or more fluorescent bulbs, one or more high-intensity discharge bulbs, and/or one or more plasma bulbs. The LED board 19 may be removably attached to the support plate 52 by one or more screws or other fasteners. The LEDs 20 may receive power from an external source of electricity (not illustrated). The electronics control assembly 16 and/or LED board 19 may be configured to control the manner in which power is supplied to the LEDs 20 from the external source of electricity.

In some embodiments, each of the LEDs 20 may be integrally formed with a primary optic or lens that provides, for example, a lambertian light distribution. Additionally, in some embodiments, each of the primary optics or lenses may be covered by a secondary optic or lens. In such embodiments, the lens 15 may be referred to as a tertiary optic or lens.

With continued reference to FIG. 4, the upwardly facing portion of the interior surface 22 of the center portion 62 of the lens 15 may be spaced apart from the LEDs 20 by a vertical distance X2. The vertical distance X2 may be equal to or greater than the vertical distance X1. The vertical distance X2 may be within a range of approximately (e.g., ±10%) 2-3 inches, or greater than or equal to approximately (e.g., ±10%) 2 inches, or greater than or equal to approximately (e.g., ±10%) 3 inches. The resulting gap between the LEDs 20 and the center portion 62 of the lens 15 may be instrumental in preventing pixilation of the light emitted by the luminaire 10.

Figure 5:
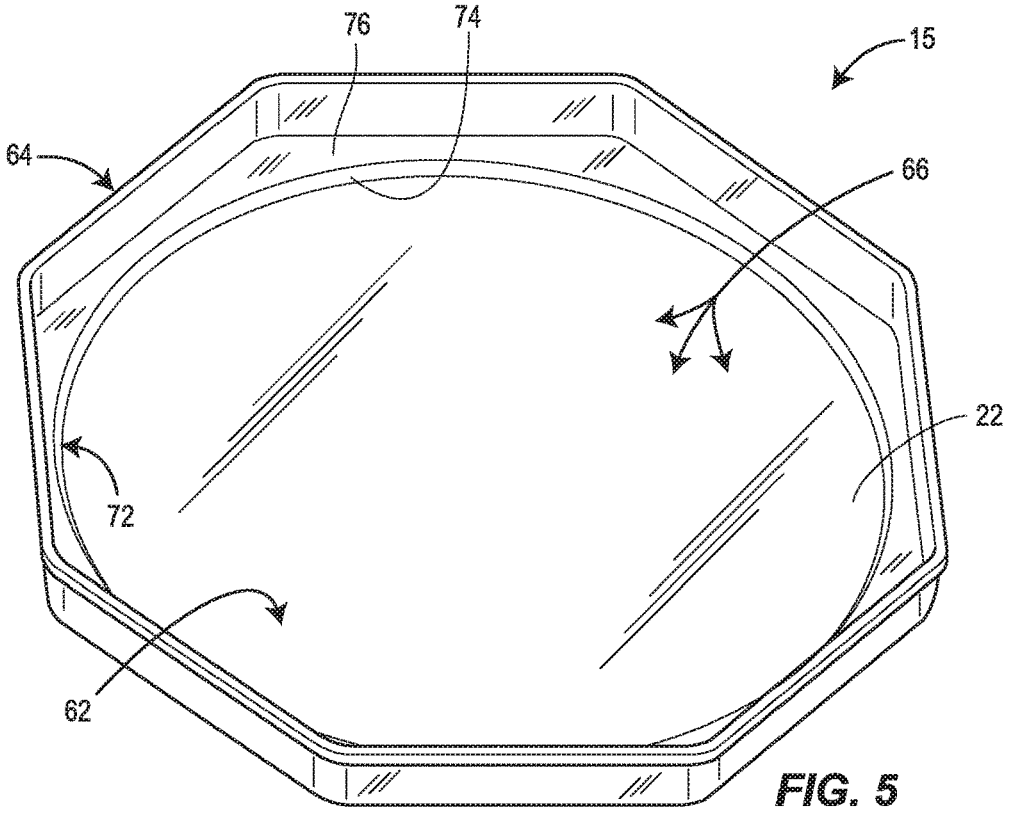
FIG. 5 is perspective top view of an embodiment of a lens in accordance with principles of the present disclosure.
Figure 6:
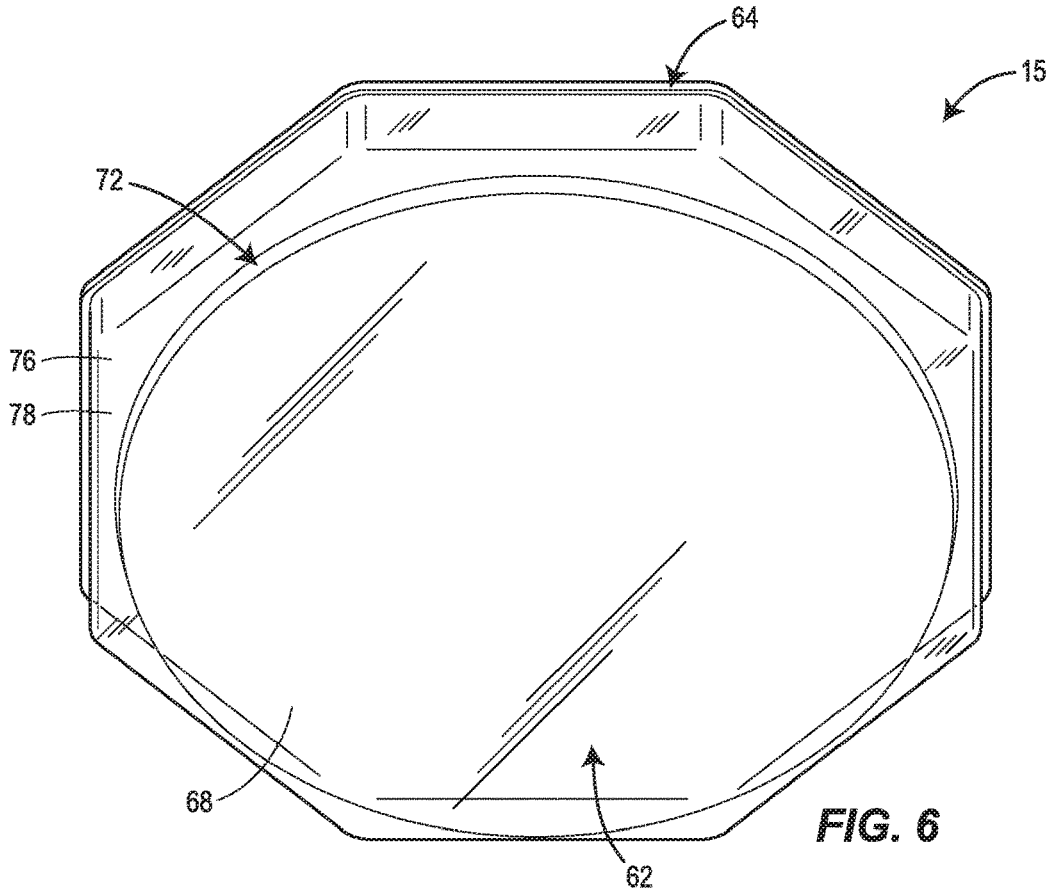
FIG. 6 is perspective bottom view of the lens depicted in FIG. 4.

Turning to FIGS. 5 and 6, the outer peripheral portion 64 of the lens 15 may be centered around the longitudinal axis A, and may extend around or circumscribe the center portion 62 of the lens 15. Furthermore, the outer peripheral portion 64 of the lens 15 may extend in an upward direction relative to the center portion 62 of the lens 15. The shape resulting from this configuration of the center portion 62 and outer peripheral portion 64 of the lens 15 may be similar to that of a relatively shallow bowl or tray, with the interior surface 22 of the lens 15 defining a cavity 66.

In some embodiments, the outer peripheral portion 64 of the lens 15 may be parallel to or substantially parallel to, or otherwise non-perpendicular to, the longitudinal axis A of the luminaire 10 or the vertical direction. In other embodiments, the outer peripheral portion 64 of the lens 15 may be angled or curved relative the longitudinal axis A but nonetheless non-perpendicular to the longitudinal axis A. While the outer peripheral portion 64 of the lens 15 in the present embodiment is a continuous wall, in alternative embodiments, one or more openings may be formed in the outer peripheral portion 64 of the lens 15. When viewed from above, the outer peripheral portion 64 of the lens 15 may have an octagonal shape, as shown in FIG. 5. Other versions of the lens 15 may have an outer peripheral portion 64 that, when viewed from above, has a circular, square, rectangular, pentagonal, hexagonal, or any other suitable geometric or non-geometric shape.

Still referring to FIGS. 5 and 6, the center portion 62 of the lens 15 may include a planar or substantially planar wall, and at least the upwardly facing portion of the interior surface 22 of the center portion 62 of the lens 15 may be perpendicular or substantially perpendicular to, or otherwise non-parallel to, the longitudinal axis A. In embodiments where the luminaire 10 is installed with the longitudinal axis A being parallel to the vertical direction, at least the upwardly facing portion of the interior surface 22 of the center portion 62 of the lens 15 may be parallel or substantially parallel to the horizontal direction. Furthermore, the center portion 62 of the lens 15 may have a generally circular shape when viewed from above and may be centered about the longitudinal axis A of the luminaire 10. Referring back to FIG. 4, a downwardly facing a portion of the exterior surface 68 of the center portion 62 of the lens 15, which may be parallel or substantially planar to the upwardly facing portion of the interior surface 22 of the center portion 62 of the lens 15, may be vertically aligned with an exterior surface 70 of the first end 44 of the annular wall 42 defining the bottom part 24 of the housing 12, such that the luminaire 10 appears to have a flat bottom when viewed from below. Furthermore, as shown in FIG. 4, the perimeter of the center portion 62 of the lens 15 may be spaced apart from the first end 44 of the annular wall 42, thereby leaving an annular portion of the opening 36 uncovered. This may permit the drainage of rainwater that has found its way into the interior space 32 of the housing 12 through the opening 28. In alternative embodiments, the center portion 62 of the lens 15 may have a hemi-spherical shape and the upwardly facing portion of the interior surface 22 of the center portion 62 of the lens 15 may or may not be parallel or substantially parallel to the horizontal direction.

Referring to FIGS. 4-6, the lens 15 may include a step-shaped shoulder portion 72 which extends around or circumscribes the center portion 62 of the lens 15, and connects the center portion 62 of the lens 15 to the outer peripheral portion 64 of the lens 15. In general, the step-shaped shoulder portion 72 may provide a transition or jog in the structure of the lens 15 that allows the outer peripheral portion 64 of the lens 15 to be hidden from view when the luminaire 10 is viewed from below. As seen in FIG. 4, the step-shaped shoulder portion 72 may include a first leg 74 connected to the center portion 62 of the lens 15 and a second leg 76 connected to the outer peripheral portion 64 of the lens 15. The first leg 74 may extend upwardly relative to the center portion 62 of the lens 15 in a direction that is parallel or substantially parallel to, or otherwise non-perpendicular to, the longitudinal axis A. The second leg 76 may extend radially outwardly relative to the center portion 62 of the lens 15 in a direction that is perpendicular or substantially perpendicular to, or otherwise non-parallel to, the longitudinal axis A. In some embodiments, the first and second legs 74 and 76 may form a right-angle corner where they meet; whereas in other embodiments, the transition between the first and second legs 74 and 76 may occur more gradually. As illustrated in FIG. 4, the second leg 76 may include a downwardly facing surface 78 that is positioned above and spaced apart by a vertical distance X3 from an interior surface 80 of the first end 44 of the annular wall 42 of the bottom part 24 of the housing 12. While the vertical distance X3 shown in FIG. 4 is constant along the width of the second leg 76, in alternative embodiments where the second leg 76 is inclined at a non-perpendicular angle or curvature relative to the longitudinal axis A, the vertical distance X3 may gradually increase when traveling along the second leg 76 in a radially outward direction.

In still further alternative embodiments, the step-shaped shoulder portion 72 may be omitted, and the center portion 62 of the lens 15 may be connected directly to the outer peripheral portion 64 of the lens. In such alternative embodiments, the outer peripheral portion 64 of the lens may be inclined at a non-perpendicular angle or curvature relative to the longitudinal axis A, such that the outer peripheral portion 64 extends upwardly and radially outwardly from the center portion 62 of the lens 15.

The lens 15 may be generally translucent and configured to diffusely transmit and/or reflect light emitted from the light source 14. In some embodiments, the lens 15 may diffusively transmit approximately (e.g., ±10%) 80% of the light from the light source 14, and diffusively reflect the remaining approximately (e.g., ±10%) 20% of the light from the light source 14. By diffusively transmitting light emitted from the LEDs 20, the lens 15 may provide a scattering effect that substantially reduces glare and/or creates the effect of a uniformly luminous surface, which is generally considered more aesthetically pleasing than the distinct points of light that may be created by the LEDs 20. The lens 15 may be constructed of any suitable material including, but not limited to, plastic (e.g., acrylic or polycarbonate) and/or glass, and this material may be chosen depending on the desired amount of light scattering.

In some embodiments, the interior surface 22 of the lens 15 and/or the exterior surface 68 of the lens 15 may be textured in order to diffusively transmit and/or diffusively reflect the light emitted from the light source 14. Additionally, in some embodiments, the lens 15 may be constructed of material which does not polarize the light emitted from the light source 14.

Referring back to FIGS. 1 and 2, additional description of the cover member 30 will now be provided. The cover member 30 may partially or entirely cover the opening 28 defined by the top part 26 of the housing 12, and may generally may function to prevent or inhibit debris such as leaves and dirt from entering the interior space 32 of the housing 12. The cover member 30 may possess an annular or ring-like shape in order to cover the opening 28. In the illustrated embodiment, the cover member 30 extends upwardly and radially inwardly from the second end 46 of the annular wall 42 of the bottom part 24 of the housing 12 toward the top part 26 of the housing 12. In addition to its ability to keep out debris, in some embodiments the cover member 30 may function as an additional lens. In such embodiments, the cover member 30 may be generally translucent and configured to diffusively transmit light reflected by the upwardly facing portion of the interior surface 22 of the center portion 62 of the lens 15, such that a viewer is not exposed to direct light as a result of the uplighting. In some embodiments, the cover member 30 may appear to glow as the result of its transmission of the light reflected in the upward direction by the lens 15. This may advantageously have the effect of reducing or eliminating any glare or eye strain caused by the uplighting. In addition, the translucent cover member 30 may have the effect of hiding or obstructing an internal heat sink, such as the one formed on the support plate 52, from view. In alternative embodiments, the cover member 30 may be transparent and may not substantially diffuse the light reflected by the upwardly facing portion of the interior surface 22 of the center portion 62 of the lens 15. In still further alternative embodiments, the cover member 30 may be opaque and may include a plurality of relatively small openings to permit the light reflected by the upwardly facing portion of the interior surface 22 of the lens 15 to pass through the cover member 30 in a generally upward direction. Such openings may also be included in the transparent and/or translucent versions of the cover member 30. FIGS. 1 and 2 illustrate a plurality of openings 84 formed in a translucent version of the cover member 30.

In some embodiments, the cover member 30 may be made of a different material than the top part 26 of the housing 12. In some embodiments, the cover member 30 may be made of plastic (e.g., acrylic or polycarbonate) or glass, and the top part 26 of the housing 12 may be made from metal (e.g., die cast aluminum and/or stainless steel). In alternative embodiments, the cover member 30 and the top part 26 of the housing 12 may be constructed of the same material.

With reference to FIG. 4, the path of a single one of the light rays (i.e., light ray 90) emitted from one of the LEDs 20 during operation of the luminaire 10 will now be described. It should be understood that during operation of the luminaire 10 multiple rays of light may be emitted from the light source 14. Initially the light ray 90 is emitted from the LED 20 in a downward and radially outward direction, such that the light ray 90 is non-parallel and non-perpendicular to the longitudinal A of the luminaire 10. Other light rays (not illustrated) emitted from the LED 20 may emitted in a downward direction that is parallel to the longitudinal axis A. Subsequently, the light ray 90 may strike the upwardly facing portion of the interior surface 22 of the center portion 62 of the lens 15 at an angle. A portion of the light ray 90 may be reflected by the upwardly facing portion of the interior surface 22 of the center portion 62 of the lens 15 such that the portion of the light ray 90 is re-directed in a generally upward and radially outward direction. In some embodiments, this portion of the light ray 90 may be diffusively reflected by the upwardly facing portion of the interior surface 22 of the center portion 62 of the lens 15 such that it scatters in multiple directions, with at least some of the scattered light rays being directed in the upwardly and radially outward direction. The portion of the light ray 90 which is not reflected by the upwardly facing portion of the interior surface 22 of the lens 15 may be transmitted through the lens 15 in a generally downward direction to provide downlighting. As shown in FIG. 4, this portion of the light ray 90 may be diffusively transmitted by the lens 15 such that it scatters in multiple directions upon emission from the downwardly facing portion of the exterior surface 68 of the center portion 62 of the lens 15. The scattering effect of the downwardly facing portion of the exterior surface 68 of the center portion 62 of the lens 15 may substantially reduce glare, and furthermore, may create the effect of a uniformly luminous surface, which is generally considered more aesthetically pleasing than a distinct point of light which the LEDs 20 may otherwise create.

After being reflected by the upwardly facing portion of the interior surface 22 of the center portion 62 of the lens 15, the reflected portion of the light ray 90 may pass through the outer peripheral portion 64 of the lens 15. In some embodiments, the reflected portion of the light ray 90 may be diffusively transmitted by the outer peripheral portion 64 of the lens 15 such that it scatters in multiple directions upon exiting through the outer surface of the outer peripheral portion 64 of the lens 15. In other embodiments, the outer peripheral portion 64 of the lens 15 may not scatter the light ray 90 as it passes therethrough.

Still referring to FIG. 4, after passing through the outer peripheral portion 64 of the lens 15, the reflected portion of the light ray 90 may travel through the interior space of the bottom part 24 of the housing 12 in a radially outward and upward direction until it strikes an interior surface 92 of the cover member 30. In some embodiments, the reflected portion of the light ray 90 may travel through the interior space of the bottom part 24 of the housing 12 without striking any other element prior to striking an interior surface 92 of the cover member 30. In other embodiments, the reflected portion of the light ray 90 may strike the interior surface 80 of the annular wall 42 of the bottom part 24 of the housing 12 and may subsequently be reflected by this surface in a more upward direction (i.e., more parallel to the longitudinal axis A) prior to striking the interior surface 92 of the cover member 30.

Thereafter, the light ray 90 may pass through the cover member 30 and exit the luminaire 10 in a generally upward direction to provide uplighting. In some embodiments, such as the one shown in FIG. 4, the light ray 90 may be diffusively transmitted by the cover member 30 such that it scatters in multiple directions upon exiting through the exterior surface 94 of the cover member 30. In other embodiments, the cover member 30 may not scatter the light ray 90 as it passes therethrough.

Accordingly, the embodiments of the luminaire disclosed herein advantageously provide both downlighting and uplighting by way of a single downwardly-directed light source. Furthermore, the luminaire makes productive use of light that is reflected internally within the luminaire, instead of allowing such light to be absorbed by the luminaire and dissipated as heat. Accordingly, efficiency gains may also be provided by the presently disclosed embodiments of the luminaire. Other benefits and advantages are also possible and will be apparent to a person of ordinary skill who reviews the present disclosure.

As used herein, the upward direction refers to any direction generally extending away from the bottom part of the luminaire toward the top part of the luminaire, and is not limited to a direction that is oriented perpendicularly relative to the surface of the Earth. As used herein, the downward direction refers to any direction generally extending away from the top part of the luminaire toward the bottom part of the luminaire, and is not limited to a direction that is oriented perpendicularly relative to the surface of the Earth.

Furthermore, it is noted that the construction and arrangement of the luminaire and its various components and assemblies as shown in the various exemplary embodiments is illustrative only. Although only a few embodiments of the subject matter at issue have been described in detail in the present disclosure, those skilled in the art who review the present disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, and vice versa. Also, the position of elements may be reversed or otherwise varied, and the nature or number of discrete elements or positions may be altered or varied. Accordingly, all such modifications are intended to be included within the scope of the present disclosure as defined in the appended claims. Furthermore, the order or sequence of any process or method steps may be varied or re-sequenced according to alternative embodiments. Other substitutions, modifications, changes and omissions may be made in the design, operating conditions and arrangement of the various exemplary embodiments without departing from the scope of the present disclosure.

What is claimed is:

1. A luminaire comprising:

a housing having a bottom end including a first opening and a top end including a second opening, wherein the bottom end includes an inwardly extending lip which at least partially surrounds the first opening and defines an exterior surface of the luminaire;

a light source disposed in the housing and configured to emit light in a downward direction toward the first opening;

a first optic at least partially covering the first opening, wherein the first optic does not extend vertically below the inwardly extending lip of the bottom end of the housing; and a second optic at least partially covering the second opening and having an optic bottom end and an optic top end, the optic bottom end being disposed radially outwardly of the optic top end.

2. The luminaire of claim 1, the second optic being arranged above the first optic.

3. The luminaire of claim 1, the second optic being centered about a vertical axis.

4. The luminaire of claim 3, the second optic including a wall extending between the bottom end and the top end, wherein the wall has a substantially constant angle of inclination relative to the vertical axis.

5. The luminaire of claim 4, the second optic having a truncated cone shape.

6. The luminaire of claim 1, at least a portion of the second optic being arranged above the light source.

7. The luminaire of claim 1, the second optic being configured to diffusively transmit light in an upward direction.

8. The luminaire of claim 1, the second optic being translucent.

9. The luminaire of claim 1, the second optic being transparent.

10. The luminaire of claim 1, an outer peripheral portion of the housing being disposed radially outwardly of the first optic, wherein the second opening is formed at least partially in the peripheral portion of the housing.

11. The luminaire of claim 1, the first optic including a center portion and an outer peripheral portion, the outer peripheral portion of the first optic surrounding a cavity defined between the center portion of the first optic and the light source.

12. The luminaire of claim 11, the outer peripheral portion of the first optic extending from the center portion of the first optic toward the light source and being at least partially disposed in the housing.

13. The luminaire of claim 12, the outer peripheral portion of the first optic being suspended from a mounting assembly disposed in the housing.

14. The luminaire of claim 13, the outer peripheral portion of the first optic spanning at least a portion of a distance separating the mounting assembly and the first opening.

15. The luminaire of claim 11, the first optic including a step-shaped shoulder portion connecting the center portion and the outer peripheral portion.

16. The luminaire of claim 15, the step-shaped shoulder portion including a downwardly facing surface positioned above and spaced apart from an upwardly facing interior surface of the housing.

17. The luminaire of claim 16, the outer peripheral portion of the first optic being centered around a vertical axis, and an interior surface of the center portion of the first optic being substantially perpendicular to the vertical axis.

18. The luminaire of claim 1, the first optic being capable of optical diffusion.

19. A luminaire comprising:

a housing having a bottom end including a first opening and a top end including a second opening, wherein the bottom end includes an inwardly extending lip which at least partially surrounds the first opening and defines an exterior surface of the luminaire;

a light source disposed in the housing and configured to emit light in a downward direction toward the first opening;

a first optic at least partially covering the first opening, the first optic including a center portion and an outer peripheral portion, the outer peripheral portion of the first optic surrounding a cavity defined between the center portion of the first optic and the light source; and a second optic at least partially covering the second opening and having an optic bottom end and an optic top end, the optic bottom end being disposed radially outwardly of the optic top end.

* * * * *